United States Patent [19]

Kobayashi

[11] Patent Number: 4,959,662

[45] Date of Patent: Sep. 25, 1990

[54] INK JET RECORDER HAVING MEANS FOR REMOVING UNUSED INK FROM INK DISCHARGE ORIFICE AND FOR CAPPING SAME

[75] Inventor: Tohru Kobayashi, Tokyo, Japan

[73] Assignee: Canon Kabushiki Kaisha, Tokyo, Japan

[21] Appl. No.: 327,428

[22] Filed: Mar. 24, 1989

Related U.S. Application Data

[63] Continuation of Ser. No. 60,474, Jun. 11, 1987, abandoned.

[30] Foreign Application Priority Data

Jun. 13, 1986 [JP] Japan ..... 61-136165

[51] Int. Cl.[5] ..... B41J 2/165

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| 4,190,844 | 2/1980 | Taylor . | |
| 4,306,245 | 12/1981 | Kasugayama et al. | 346/140 R |
| 4,369,450 | 1/1983 | Iwagami | 346/140 X |
| 4,410,900 | 10/1983 | Terasawa | 346/140 R |
| 4,411,706 | 10/1983 | Wallace | 346/25 X |
| 4,543,589 | 9/1985 | Terasawa | 346/140 R |
| 4,559,543 | 12/1985 | Toganoh | 346/140 |
| 4,577,203 | 3/1986 | Kawamura | 346/140 |
| 4,739,340 | 4/1988 | Terasawa | 346/140 |
| 4,819,012 | 4/1989 | Kiyohara | 346/140 R |

FOREIGN PATENT DOCUMENTS

| | | |
|---|---|---|
| 2808200 | 9/1978 | Fed. Rep. of Germany . |
| 2920371 | 12/1979 | Fed. Rep. of Germany . |
| 54-52242 | 7/1979 | Japan . |
| 54-159226 | 12/1979 | Japan . |
| 60-184851 | 2/1986 | Japan . |
| 61-199955 | 6/1986 | Japan . |
| 1598779 | 9/1981 | United Kingdom . |
| 2112715 | 7/1983 | United Kingdom . |

*Primary Examiner*—Joseph W. Hartary

*Attorney, Agent, or Firm*—Fitzpatrick, Cella, Harper & Scinto

[57] ABSTRACT

There is disclosed an ink jet recorder having an ink jet record head including an orifice to discharge ink, comprising: a gas jet unit for jetting gas to remove nonused ink discharged from the orifice; and a liquid receptor means for accommodating the removed nonused ink.

8 Claims, 3 Drawing Sheets

INK JET RECORDER HAVING MEANS FOR REMOVING UNUSED INK FROM INK DISCHARGE ORIFICE AND FOR CAPPING SAME

This application is a continuation of application Ser. No. 060,474, filed June 11, 1987, now abandoned.

BACKGROUND OF THE INVENTION

1. Field of the Invention

The present invention relates to an ink jet recorder which discharges ink from an orifice and deposits it onto a record medium such as a sheet to record data, and more particularly to an ink jet recorder having removal means for removing nonused ink discharged from the orifice.

2. Related Background Art

An ink jet recorder which discharges ink to record data has been known. Such an ink jet recorder usually comprises an ink jet record head having an ink discharge function such as a liquid path including an orifice through which ink is discharged, discharge energy generation means for supplying discharge energy to the ink, and an ink supply system including an ink tank from which the ink is supplied to the ink jet record head externally of the head.

In such an ink jet recorder, when an environment in which the recorder is used changes or the recorder has not been used for a long time, a viscosity of the ink in the liquid path increases or air bubbles are generated in the ink supply system, and the ink may not be discharged or is hardly discharged. Thus, the ink jet recorder usually has an ink recovery system including a liquid seal member such as a cap to prevent evaporation of the ink from the orifice during non-record mode in order to prevent the viscosity of ink from increasing, and a recirculation pump for discharging the high viscosity ink and air bubbles in the liquid path out of the liquid path.

When such an ink recovery system is operated to recover the discharge operation in liquid path, nonused ink discharged from the ink jet orifice drops along the ink jet record head. If it is left, the vicinity of the head is made dirty. Accordingly, an exhaust ink receptacle is provided below the ink jet record head or a liquid absorbing material such as porous ceramics is provided in the ink jet record head to prevent the recorder from being made dirty by the ink.

However, the exhaust ink dropped through the recovery operation may adhere easily to the vicinity of the orifice, and if it is left, the recording may not be attained or the quality of the record is degraded. Even if it does not adhere, the nonused ink gradually piles up in the vicinity of the orifice through long-time use and the piled nonused ink impedes the discharge of the ink. Further, dust may deposit onto the nonused ink and the discharge of the ink is impeded. The discharge of the nonused ink from the orifice may occur by a sudden rise of ambient temperature. Solution for the problem relating to the nonused ink has been required.

SUMMARY OF THE INVENTION

It is an object of the present invention to provide an ink jet recorder which can readily remove nonused ink discharged from an orifice, maintains a performance of an ink jet record head throughout a long-time use and assures high quality recording over a long period.

The above object of the present invention is achieved by an ink jet recorder having an ink jet record head including an orifice through which ink is discharged, the ink jet recorder comprising a gas jet nozzle for jetting gas to remove nonused ink discharged from the orifice, and a liquid acceptor for accommodating the removed nonused ink.

DETAILED DESCRIPTION OF THE PREFERRED EMBODIMENTS

Figure 1:
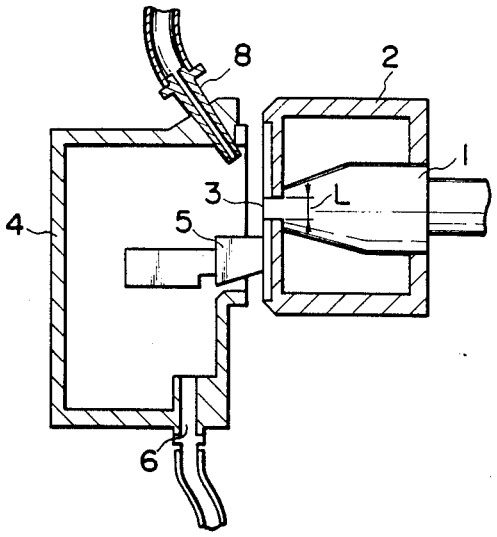
FIG. 1 is a sectional view of a vicinity of a record head in one embodiment of an ink jet recorder of the present invention.

FIG. 1 shows a sectional view of major portions, among others those around an ink jet record head, of one embodiment of the ink jet recorder of the present invention.

Figure 4:
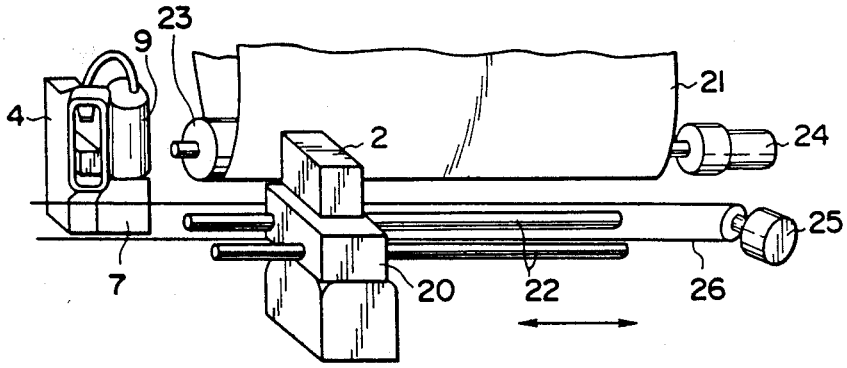
FIG. 4 shows major portions of the embodiment of the ink jet recorder of the present invention, FIGS. 5(*a*) and 5(*b*) show an embodiment of a drive transmission mechanism of the ink jet recorder of the present invention.

In FIG. 1, numeral 1 denotes a known ink jet record head which discharges ink from an orifice 3 in accordance with a record signal to record data. As shown in FIG. 4, the head 1 is mounted on a carriage which is movable in a record direction (main scan direction) on a shaft arranged in parallel to a record medium. Numeral 2 denotes a head holder for fixing the ink jet record head 1 to the carriage. A desired number of orifices 3 are usually provided depending on a type of record such as color record. In the present embodiment, a plurality of orifices are arranged along a length L. When color record is required, three or four record heads 1 may be arranged.

Figure 2:
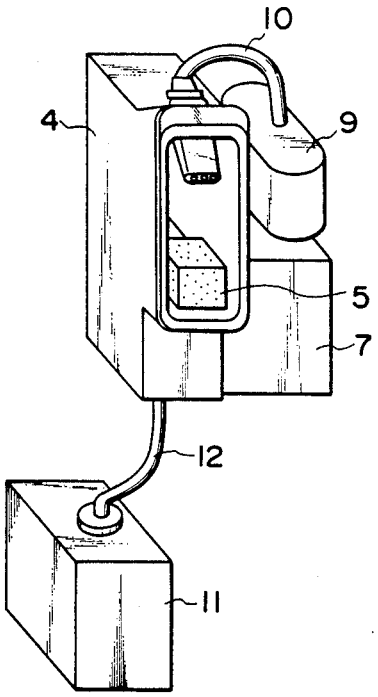
FIG. 2 is a perspective view of a vicinity of a cap container of the ink jet recorder of the present invention, FIGS. 3(*a*) to 3(*c*) illustrate an operation of the ink jet recorder of the present invention.

Numeral 4 denotes a cap container which abuts against the head holder 2 in a non-record mode and functions as a liquid seal member to define a closed space in order to prevent the viscosity of the ink in the ink jet record head 1 from increasing by evaporation by performing the capping operation so that the periphery of the orifice is tightly sealed. In the present embodiment, the cap container 4 is provided with a gas jet nozzle and a liquid acceptor in order to remove nonused ink discharged from the orifice. FIG. 2 shows a perspective view of a vicinity of the cap container 4.

Figure 3A:
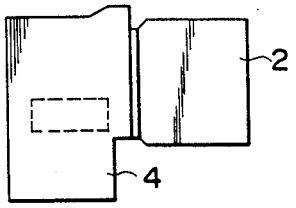
Figure 3B:
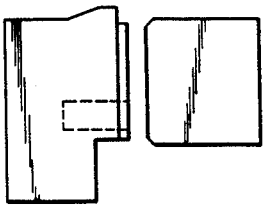
Figure 3C:
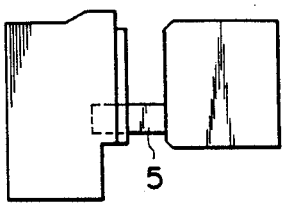

The cap container 4 includes a liquid absorbing member 5 which serves as the liquid accepting means to accommodate the nonused ink discharged from the orifice 3. The liquid absorbing member 5 can abut against the orifice of the ink jet record head 1 as shown in FIG. 3. Numeral 7 denotes a drive transmission mechanism to bring the cap container 4 into contact with the record head 1 or move away from the record head. Numeral 6 denotes an eject port through which the nonused ink is ejected out of the cap container. Numeral 12 denotes a tube through which the ink ejected from the eject port 6 is sent to an exhaust ink container 11. In the present embodiment, the liquid absorbing material 5 is used as the liquid acceptor, although the liquid acceptor may be a receptacle. From a standpoint of liquid acceptance efficiency, the liquid absorbing member 5 made of porous material such as polyvinyl alcohol or polyamide is preferable.

A gas jet nozzle 8 as a gas jet nozzle means is arranged at the top of the cap container 4 in a manner to allow gas jetting from the container, and blows the nonused ink ejected from the orifice 3 toward the liquid absorbing material 5. Numeral 9 denotes an air pump for supplying air to be jetted from the gas jet nozzle 8, and numeral 10 denotes a pipe for connecting the air pump 9 and the gas jet nozzle 8. In the present embodiment, air is used as the jet gas, although it may be $N_2$ gas. The jet gas need not be supplied by the air pump but it may be sent by fan motor, blower motor or diaphragm pump. In the present embodiment, the gas jet nozzle 8 has a plurality of gas discharge ports, although only one gas discharge port may be provided. However, where a plurality of orifices 3 are arranged in the main scan direction of the ink jet record head, a plurality of gas discharge ports corresponding to the plurality of orifices are preferably provided in order to properly control the direction of flow of the nonused ink. More preferably, the width of the gas blown by the gas jet nozzle 8 is wider than the width of array of the orifices 3. The gas discharge port may be a slit.

An operation of the ink jet recorder is now explained.

In a non-record mode, the cap holder 4 contacts the head holder 2 as shown in FIG. 3(*a*), and the liquid absorbing material 5 shown by broken lines in FIG. 3(*a*) is accommodated in the cap container and the ink jet record head 1 is shut off to external air by the cap container 4 so that the increase of viscosity of the ink is prevented. When a record operation is started, or when the ink cannot be discharged by the increased viscosity or adherence of the ink or the deposition of dust, the ink recovery operation of the record head is carried out. In this case, the cap container 4 retracts from the position shown in FIG. 3(*a*) to the position of FIG. 3(*c*) through the position of FIG. 3(*b*), and the liquid absorbing material 5 abuts against the head holder 2 while it projects from the cap container 4.

In the position shown in FIG. 3(*c*), the ink is circulated by an ink supply circulation device, not shown to eject the increased viscosity ink and air bubbles in the ink jet record head from the orifice 3. The nonused ink thus ejected drops along the surface of the record head.

The nonused ink readily adheres to the record head, and if it is left, it causes failure of ink discharge and makes the recorder dirty. In the present invention, such nonused ink can be readily removed by the gas jet nozzle and the liquid acceptor. Simultaneously with the drop of the nonused ink, the air pump 9 is started so that air is blown out of the gas jet nozzle 8.

Thus, the nonused ink rapidly drops along the surface of the record head by the air flow and is absorbed by the liquid absorbing material 5 which abuts against the bottom of the head. Accordingly, in the present invention, the nonused ink does not adhere to the surface of the record head, and the surface of the head is always kept clean. After the drop of the ink has been terminated, the air pump 9 is stopped to terminate the ink recovery operation.

After the recovery operation, the liquid absorbing material 5 is retracted as shown in FIG. 3(*b*), and the carriage 20 is scanned left and right in front of the record medium 21 to record data. FIG. 4 shows major portions of an embodiment of the ink jet printer having the gas jet nozzle 8 and the liquid absorbing material 5. Numeral 20 denotes a carriage which carries the ink jet record head held in the head holder 2. The carriage 20 is slidably arranged on a shaft 22 extending in parallel to a platen 23, and it is movable left and right in front of the record medium 21 by a belt 26 coupled to a carriage feed motor 25. Numeral 24 denotes a feed motor for the record medium 21.

Figure 5A:
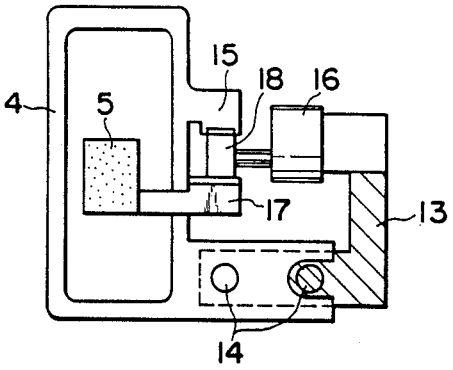
Figure 5B:
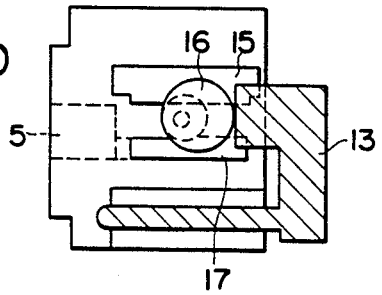

FIGS. 5(*a*) and 5(*b*) show an embodiment of the drive transmission mechanism 7 which carries out the operation shown in FIGS. 3(*a*) to 3(*c*). FIG. 5(*a*) shows a sectional view of the drive transmission mechanism 7 cut along a plane parallel to a facing plane of the ink jet record head to the record medium, and FIG. 5(*b*) shows a side view of the drive transmission mechanism 7 as viewed from the platen.

In FIGS. 5(*a*) and 5(*b*), the cap container 4 is mounted on a guide 14 which is fixed to a frame 13, and is slidable in the direction of the ink jet record head. Rack gears 15 and 17 are fixed to the cap container 4 and the liquid absorbing material 5, respectively, and the rack gear 17 fixed to the liquid absorbing material 5 is slidable in parallel to the cap container 4 and the guide 14. Numeral 18 denotes a spur gear for transmitting the rotation of the motor 16 to the rack gears 15 and 17.

In FIGS. 5(*a*) and 5(*b*), the cap container 4 is at a position corresponding to FIG. 3(*b*) separated from the ink jet record head. In order to switch to the position shown in FIG. 3(*c*), the motor 16 is rotated to move the cap container 4 to the right in FIG. 5(*b*) and move the liquid absorbing material 5 to the left until it abuts against the ink jet record head, and then the motor 16 is stopped. In order to switch to the position shown in FIG. 3(*a*), the motor 16 is rotated in the opposite direction until the cap container 4 abuts against the ink jet record head, when the motor 16 is stopped.

Figure 6:
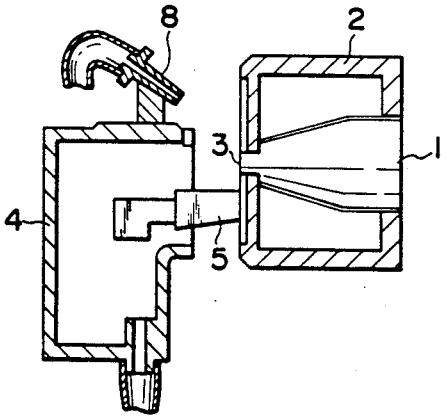
FIG. 6 is a sectional view of a modification of the ink jet recorder of the present invention.

FIG. 6 shows another embodiment of the ink jet recorder of the present invention. In the present embodiment, the gas discharge port of the gas jet nozzle 8 is not arranged in cap container 4 as shown in FIG. 1 but is arranged externally of the cap container. The same effect as that attained in FIG. 1 is offered.

In the above embodiments, the gas jet nozzle and the liquid acceptor are arranged in the cap container which serves as the liquid seal member. The present invention is not limited to the illustrated embodiments but the gas jet nozzle and the liquid acceptor may be arranged separately from the liquid seal member. In this case, a high sealing property in the liquid seal member is not required and the object of the present invention may be achieved by arranging the gas jet nozzle and the liquid acceptor on a support member having an enclosure to prevent nonused ink from scattering. The embodiment of the ink jet recorder in which the gas jet nozzle and the liquid acceptor are integral with the liquid seal member is most preferable because the number of parts required is small and the drive mechanism is simple.

Although, in the above embodiment, the gas jet is executed against the orifice 3 under the condition that the recording head is not capped by the cap 4, the scope of the present invention is not limited to the above embodiment.

That is to say, in an another embodiment, the gas jet may be executed to the orifice 3 with the suction of gas and liquid from the discharge port 6 under the condition, such as the condition shown in FIG. 3(*a*), that the recording head is capped by the cap 4. In the above another embodiment, the undesired ink is smoothly removed because the ink removed from the orifice by the gas jet is prevented from scattering outside of the cap 4.

The ink jet recorder of the present invention has the gas jet nozzle for jetting gas to remove the nonused ink discharged from the orifice and the liquid acceptor to accommodate the removed nonused ink. Thus, it can easily remove the nonused ink from the surface of the ink jet record head and accommodates the removed nonused ink in the liquid acceptor. Accordingly, the recorder including the ink jet record head is not made dirty, the degradation of the record quality by the nonused ink is prevented, and high quality of record is assured over a long period.

In accordance with the present ink jet recorder having the gas jet nozzle and the liquid acceptor, the nonused ink discharged from the orifice can be rapidly removed without making the recorder dirty. Accordingly, the degradation of the quality of record caused by the nonused ink in the prior art recorder is prevented, and a high quality of record is assured over a long period. Further, maintenance is not required over alongtime use.

I claim:

1. A method for recovering unused ink from an ink jet recording head during a recovery process, said method comprising the steps of:

providing an ink jet recording head having an orifice for discharging ink therefrom;

ejecting ink from said orifice during said recovery process;

jetting gas from above said orifice toward said orifice to blow ink ejected therefrom downwardly during said recovery process; and collecting ink ejected from said orifice and blown downwardly therefrom by said jetted gas using an ink absorbing member disposed below said orifice and in abutment with a surface adjacent said orifice, wherein said ejecting and jetting steps are performed substantially at the same time.

2. An improved ink jet recording apparatus for recovering ink during a non-recording operation, said apparatus comprising:

an ink jet recording head having a discharge port for discharging ink therefrom;

a cap container for covering said discharge port and collecting ink ejected from said discharge port, said cap container having gas jet means with a gas jetting port disposed above said discharge port for jetting gas toward said discharge port during said non-recording operation and an ink absorbing member disposed in said cap container below said discharge port for absorbing ink ejected from said discharge port;

ejecting means for ejecting ink from said discharge port during the non-recording operation; and moving means for moving said ink absorbing member relative to said cap container to cause said ink absorbing member to abut said recording head during said non-recording operation, wherein during said non-recording operation ink ejected from said discharge port is blown downwardly by gas jetted from said gas jetting port toward said ink absorbing member to be absorbed thereby.

3. An improved ink jet recording apparatus for recovering during a recovery process, said apparatus comprising:

an ink jet recording head having on a surface thereof an orifice for discharging ink therefrom;

recovery means for ejecting ink from said orifice during the recovery process; and a cap for capping said orifice to collect ink ejected from said orifice, said cap having gas jet means with a gas jetting port disposed above said orifice for jetting gas downwardly toward said orifice while ink is ejected from said orifice during said recovery process, and an ink absorbing member disposed below said orifice and abutting said surface of said ink jet recording head, wherein during said recovery process ink ejected from said orifice is blown downwardly by gas jetted from said gas jetting port toward said ink absorbing member to be absorbed thereby.

4. An ink jet recorder according to claim 3 wherein a plurality of said orifices are provided.

5. An ink jet recorder according to claim 4 wherein a width of an area blown by said gas jet means is wider than a width of an array into which said orifices are arranged.

6. An ink jet recording apparatus according to claim 3, 4 or 5 wherein said ink absorbing member is movable between a position abutting said ink jet recording head, or a head holder holding said ink jet recording head, when gas is jetted by said gas jet means and a position where said ink absorbing member does not abut said ink jet recording head or head holder.

7. An apparatus according to claim 3, wherein the gas jetting of said gas jet means is executed when said capping is performed.

8. An apparatus according to claim 3, wherein the gas jetting of said gas jet means is executed when said capping is not performed.

* * * * *

UNITED STATES PATENT AND TRADEMARK OFFICE

CERTIFICATE OF CORRECTION

PATENT NO. : 4,959,662

DATED : September 25, 1990

INVENTOR(S) : TOHRU KOBAYASHI

It is certified that error appears in the above-identified patent and that said Letters Patent is hereby corrected as shown below:

TITLE PAGE:

AT [56] REFERENCES CITED

Foreign Patent Documents,
"60-184851 2/1986 Japan ."
"61-199955 6/1986 Japan ." should read
--60-184851 9/1985 Japan .--.
--61-199955 9/1986 Japan .--.

AT [57] ABSTRACT

Line 4, "receptor" should read --acceptor--.

COLUMN 3

Line 45, "shown" should read --shown,--.

UNITED STATES PATENT AND TRADEMARK OFFICE

CERTIFICATE OF CORRECTION

PATENT NO. : 4,959,662

DATED : September 25, 1990

INVENTOR(S) : TOHRU KOBAYASHI

It is certified that error appears in the above-identified patent and that said Letters Patent is hereby corrected as shown below:

COLUMN 4

Line 65, "an" should be deleted.

COLUMN 5

Line 24, "along-" should read --long- --.

COLUMN 6

Line 15, "covering" should read --covering ink--.

Signed and Sealed this

Twenty-second Day of September, 1992

*Attest:*

DOUGLAS B. COMER

*Attesting Officer*

*Acting Commissioner of Patents and Trademarks*